United States Patent [19]

Blain et al.

[11] Patent Number: 4,766,978

[45] Date of Patent: Aug. 30, 1988

[54] ELEVATOR SYSTEM ADAPTIVE TIME-BASED BLOCK OPERATION

[75] Inventors: Jeffrey W. Blain, Scenic Lakes Township, Sussex County; Denis D. Shah, Union, both of N.J.

[73] Assignee: Westinghouse Electric Corp., Pittsburgh, Pa.

[21] Appl. No.: 109,640

[22] Filed: Oct. 16, 1987

[51] Int. Cl.[4] ..... B66B 1/18

[52] U.S. Cl. ..... 187/101; 187/124

[58] Field of Search ..... 187/101, 102, 124

[56] References Cited

U.S. PATENT DOCUMENTS

| | | | |
|---|---|---|---|
| 4,345,670 | 8/1982 | Kaneko et al. | 187/102 |
| 4,397,377 | 8/1983 | Husson et al. | 187/101 X |
| 4,473,133 | 9/1984 | Enriquez et al. | 187/101 |

*Primary Examiner*—William M. Shoop, Jr.
*Assistant Examiner*—W. E. Duncanson, Jr.
*Attorney, Agent, or Firm*—J. L. Brzuszek

[57] ABSTRACT

An elevator control system and method for efficient failure control of block operation with a local area network on the traveling cable and distributed electronic control circuits in the car and proximate to the respective floors with a remote microprocessor controller for each car. A local area network also provides communication with the corridor fixtures in a serial signal format of input and output signals. Each remote controller includes a microprocessor based computer circuit which normally communicates over a multicar-link with the other and also over the local area networks for car and hall calls. Each controller implements an adaptive time based block operation with the total building being serviced, despite partial or total failure of communication between the controllers and the corridor fixtures, which would otherwise degrade the bank operation sooner and more restrictively.

10 Claims, 4 Drawing Sheets

ELEVATOR SYSTEM ADAPTIVE TIME-BASED BLOCK OPERATION

CROSS REFERENCE TO OTHER APPLICATIONS

The present application is related to the following concurrently filed U.S. patent applications Ser. No. 109,638, by J. W. Blain, et al. and entitled "Elevator System Master Car Switching", Ser. No. 109,639, by J. W. Blain et al. and entitled "Elevator System Graceful Degradation of Bank Service"; and to concurrently filed on June 19, 1987, Ser. No. 064,915, by D. D. Shah et al. and entitled "Elevator System Monitoring Cold Oil"; and Ser. No. 064,913, by J. W. Blain et al. and entitled "Elevator System Leveling Safeguard Control and Method", all of which are assigned to the same as the present assignee and the disclosures of which are incorporated herein by reference.

BACKGROUND OF THE INVENTION

1. Field of the Invention

This invention relates in general to traction and hydraulic elevator systems with distributed control circuits, and more particularly, to a method and control system for protecting against an excessively restrictive block operation elevator service because of the loss of communication control in the system.

2. Description of the Prior Art

The failure of communication with the hallway fixtures by a controller used with present day elevator control apparatus normally has a back-up mode of through trip or block operation with some form of service being retained, but it is of significantly inferior quality to the normal service since the building is not totally served if all car controllers are implementing a fixed block operational service to the bottom floor.

Computers have heretofore been pre-programmed to perform various functions in the operational control or management of car and hall call response strategies in an elevator system such as in U.S. Pat. No. 4,511,017 which provides emergency back-up elevator service, or a variation in block operation, when normal service is degraded, by preassigning and revising blocks of car assignments to floors in a rotational manner.

Various arrangements for elevator bank configurations have been known to benefit from the state-of-the-art solid-state controllers, but assuming that dynamically defined tasks involve progressively activated block operational failure mode arrangements; these have yet to emerge to be the least restrictive, while providing total service to the building.

With the introduction of microprocessor based elevator controllers and the distribution of electronic circuits located with each car and proximate to the respective floors, communication with the remote controllers is of fundamental concern since the integrity of hall call signals, and the control strategy in assigning cars to answer these calls, is critical to operational efficiency and to the satisfied customer. Not less important to this goal is that passengers should continue to be provided with total service in the building, with the controllers providing their most efficient service even when relegated to operate in the mode of block operation.

One of the principal problems is in providing a shared service to a floor by all of the controllers on block operation so that each associated car will service all of the floors accessible to it. All cars going on a mode of block operation which is non-adaptive does not provide the best car efficiency for the bank of cars which still has the potential for providing more efficient service to minimize waiting time.

SUMMARY OF THE INVENTION

The present invention is a new and improved elevator system and method for protecting against an excessively restrictive block operation elevator car service, and is essentially of the type which uses a distributed control system implemented with electronic circuits. These circuits are located with each car of a two-car-pair and at each floor for corridor call information and have input and output signals which are communicated serially for each car over a traveling cable connected to an associated per car remote controller.

Each remote controller includes a microprocessor based computer circuit, which is also serially connected over a communication link to the distributed electronic circuits proximate to each floor and normally serves to implement a two-car-pair floor control (FC) master strategy for responding to hall calls. The remote controllers normally function individually to respond to car associated calls. Each non-FC controller normally remains on standby to assume implementing the floor control master strategy in an expanded control strategy for answering hall calls, without excessive degradation of service.

If the selected floor controller for this responsibility fails or there is a communication failure with it, and the failure eliminates the capacity for another controller to communicate with the distributed electronic circuits proximate to each floor. For corridor call information, the cars are adaptively put on a block operation mode.

The microprocessor for each car repeatedly implements a program with an adaptive time-based block operation failure mode within an expanded failure mode program, and another program selects which remote controller should assume or retain the role of directing the floor control master strategy for the two-car-pair as it signals this status to the other remote controller. This controller then controls a set of floor control circuits over a serial communication riser for processing the hall calls, and it sends back corridor signals of an audible and visual type which it continues to implement as long as serial riser communication is possible in order to provide service information to a waiting passenger.

If the selected controller cannot communicate with the associated controller in the two-car-pair, and is unable to gain control of the serial riser, it activates itself for block operation and provides the opportunity for its associated controller to gain control of the serial riser to operate as a single car system, only if it can satisfy the stated communication requirements; otherwise, it too goes on block operation.

Further in accordance with the invention, the adaptive block operation program provides that each car controller put on block operation begins counting down a "wait-timer" or software counter starting from a time when a hall call is answered at a particular floor, with the wait timer being loaded thereat with a wait time for that floor. The respective wait-time is directly proportional to the number of cars that it is being serviced by, and service to the floor is shared by all car controllers and hence all cars that are on block operation.

BRIEF DESCRIPTION OF THE DRAWINGS

The invention may be better understood, and further advantages and uses thereof more readily apparent, when considered in view of the following detailed description of exemplary embodiments taken with the accompanying drawings in which.

DESCRIPTION OF A PREFERRED EMBODIMENT

The invention is a new and improved elevator system and a method for protecting against an excessively restrictive block operation elevator car service and is essentially of the type which uses a distributed control system disposed partly in a plurality of elevator cars and partly in an associated plurality of remote controllers disposed therefrom while communicating over a travelling cable serving as a local area network (LAN) using token passing strategies for bi-directional communication. Each car associated remote controller is grouped into a two-car-pair which is serially connected over a communication link to a plurality of distributed electronic circuits proximate to each floor in order to implement a two-car-pair strategy for responding to hall calls, while the remote controllers function individually to respond to their car associated car calls.

The remote controllers communicate with each other over a third serial network link so that each remains on standby with respect to the other to assume implementing a single car system floor control strategy with the other car controller put on adaptive block operation program in an expanded control strategy, without excessive degradation, of service, should there be a communication failure or failure in the previously established remote controller priority of operation, and ultimately the bank of cars will operate with each car controller activating the program for time-based adaptive block operation if the serial link capacity for communication with the distributed electronic circuits proximate to each floor has completely failed.

The new and improved system and method are described by illustrating only those parts of an elevator system pertinent to the understanding of the invention, and supplemental portions of the elevator system have been incorporated by reference to an allowed U.S. patent assigned to the same assignee as the present application. Accordingly, allowed U.S. patent application Ser. No. 829,744 filed Feb. 14, 1986, entitled "Elevator Communication Controller", describes an addressable elevator communication controller for controlling full duplex serial communication between various remotely located corridor fixtures and car functions in a controller which controls a central bank of elevator cars. Each communication controller may be placed on a single IC custom chip which may be used redundantly in the elevator system in order to control the various corridor fixtures including hall call pushbuttons and associated indicator lamps, up and down hall call lanterns located at each floor, digital or horizontal car position indicators and status panels located at selected floors. It is used as well for elevator car located functions such as the door controller, car position indicator, direction arrows, and the car call pushbuttons and associated indicator lamps.

Figure 1:
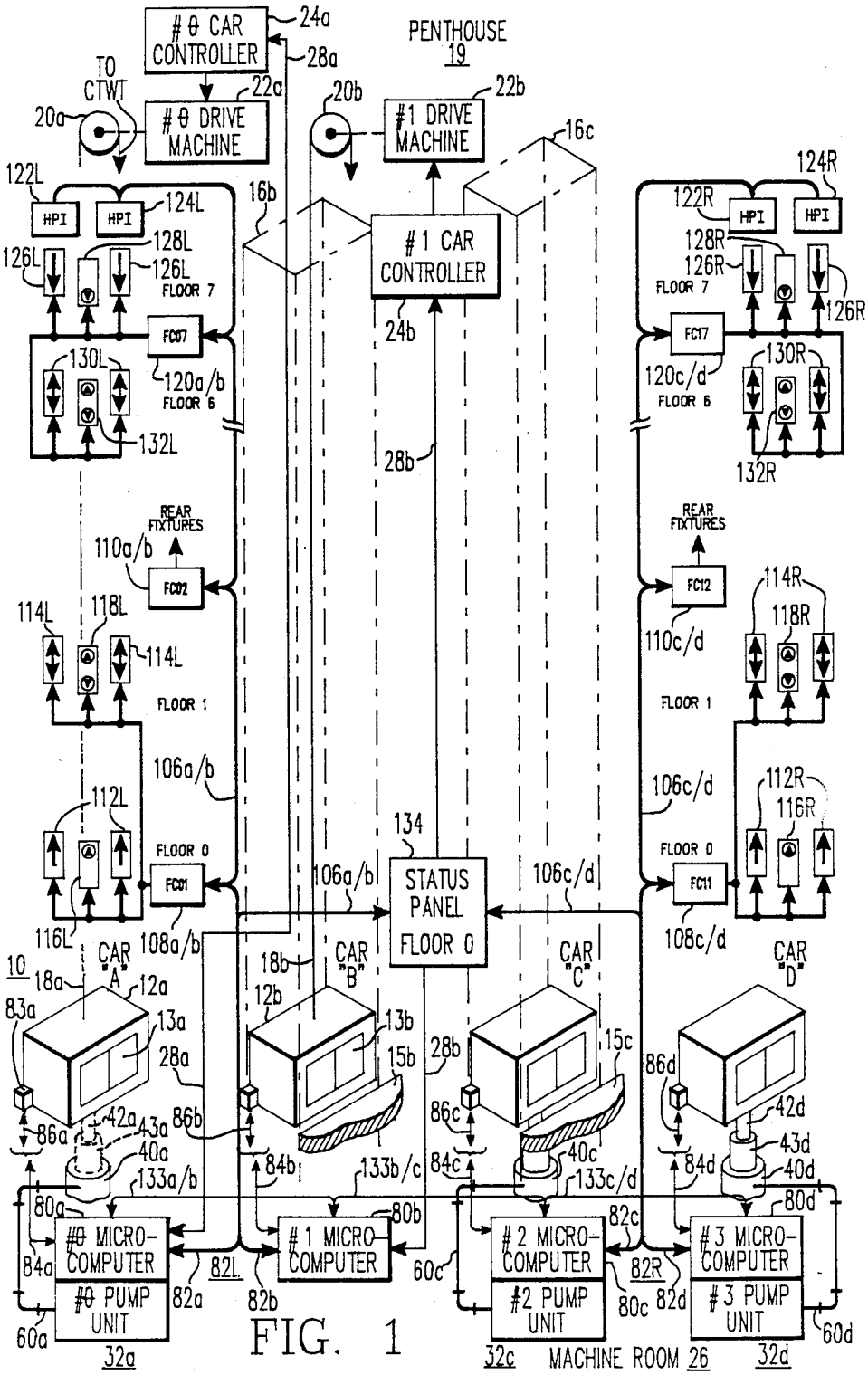
FIG. 1 is a block diagram of a plural car elevator system, shown driven in the alternative with either traction or hydraulic drives and including remote controllers which may be implemented in two-car-pair sets and operated according to the teachings of the invention.

More specifically, FIG. 1 now shows an elevator system 10 which may incorporate this controller which may be utilized according to the teachings of the present invention. The elevator system 10 includes one or more elevator cars, or cabs, such as elevator car 12*a*, the movement of which is alternatively driven either as shown above the car from a penthouse 19 in a building structure (not shown), as in a traction elevator system, or as shown from below the car in a machine room 26, as when the implementation is in a hydraulic elevator system. When the invention is used in a traction elevator system, the car 12*a* is mounted in a hatchway of the building structure, such as shown for car "B", which forms with car "A" a two-car-pair which occupies the space to the left of center in the drawing of FIG. 1. The building structure has a plurality of landings such as the ZERO, 1ST, 6TH, 7TH floors or landings which are shown in order to simplify the drawing.

The car 12*a* is supported by a plurality of wire ropes 18*a* which are reeved over a traction sheave 20*a* mounted on the shaft of a drive machine 22*a* regarded as the #0 drive machine and a counterweight (CTWT now shown) is connected to the other ends of the ropes 18*a*. A similar arrangement is shown for car "B" which is supported by the wire ropes 18*b* over the sheave 20*b* and driven by the #1 drive machine 22*b*. The drive machine 22*a*, 22*b* may be AC systems having an AC drive motor, or a DC system having a DC drive motor such as used in the Ward-Leonard drive system or it may use a solid-state drive system.

A traction elevator system incorporates a car movement detection scheme to provide a signal for each standard increment of travel of the car such as 0.25 inch of car travel. This may be developed in several ways with one such way using a sensor located on car 12*a* cooperating with indicia disposed in the hatchway. Distance pulses are then developed for a car controller 24*a* which includes a floor selector and speed pattern generator for the elevator system. A further discussion of a car controller and a traction elevator system of the type in which a pulse count is maintained to enable a car to be leveled in the correct travel direction is described U.S. Pat. No. 4,463,833 which is assigned to the assignee of the present application, and the present invention may be used to enhance the functioning thereof.

Normally the car controller 24*a* through its floor selector keeps track of the position and the calls for service for the car 12*a*, and it also provides the starting and stopping signals for the car to serve calls, while providing signals for controlling auxiliary devices such as the door control for the elevator car doors 13*a*. Likewise, the car controller 24b for car "B" provides the same functions as the car controller 24a does for its respective car "A". In the two-car-pair traction elevator system of the present invention, each of the respective car controllers 22a and 22b controls hall lanterns such as hall lantern pair of up-floor lanterns 112L associated with the pushbutton 116L at FLOOR 0, and each of the controllers also controls the resetting of the car call and hall call controls when a car or hall call has been serviced. Car 12b is shown located at the landing 15b with its doors 13b shown in a closed position.

The simplification and abbreviation of the elevator system 10 thus far described in FIG. 1 presumes that a traveling cable 84a for car "A" and a traveling cable 84b for car "B" provide, respectively, bi-directional communication paths to the respective control electronics for each car. Microprocessing control electronics may be located in the penthouse 19 proximate to the car controllers 24a and 24b or as shown remote therefrom as in FIG. 1 with correspondingly numbered micro-computers #0 and #1 which are located in a machine room 26. In this instance, the #0 micro-computer 80a is connected on a car control communication link 28a to the car controller 24a, and likewise #1 micro-computer 80b is connected on a car control communication link 28b to the car controller 24b in order to provide a complete bi-directional communication path for the cars over the respective traveling cables and car control links.

The traveling cable 84a is a composite cable in the sense that a control cable is present therein in order to control certain relay logic functions for the car door operator of car 12a, and there is also present a CAR DATALINK 86a which is shown emerging from the bottom of car "A" or from a car position terminal 83a shown functionally located on the side of the car 12a. A similar arrangement for car "B" is intended for the traveling cable 84b which is shown for purposes of this description in the same respective alignment with respect to car "B". This provides the proper complement of relay control functions as well as the bi-directional communication paths for the #1 micro-computer 80b connected thereto. The conductors in the CAR DATALINK 86a are constituted in an arrangement of three pairs of two conductor wires that are twisted and shielded from extraneous noise which might be otherwise inductively coupled to the traveling cable. This cabling is used in order to preserve data quality of the transmission signals and to ensure the credibility of the information received at the circuits in the car as it relates to the control of the car operation through various control circuit boards (not shown herein). Floor circuit boards of the type which may be used in the present invention are disclosed in FIG. 1 of the aforementioned U.S. allowed application Ser. No. 829,744, filed Feb. 14, 1986, which is incorporated by reference in the teachings of the present invention.

The description has thus far proceeded on the basis for FIG. 1 that cars "A" and "B" are in a two-car-pair for a traction elevator system with the respective micro-computers 80a and 80b located remote from the car controllers 24a and 24b which are shown in the location of the penthouse 19. Also shown in FIG. 1 is the provision for bi-directional communication paths from the micro-computers 80a and 80b to the various corridor fixtures via a HOISTWAY DATALINK 82a and 82b which are collectively designated 82L (Left side designation). These may be constituted by three pair of two conductor wires 106a/b which are twisted and shielded from extraneous noise and ensure the highest quality of data transmission. Located in the hatchway 16b at some appropriate position with respect to the floor 0 and 1ST is shown FC01, a hall fixture circuit board 108a/b which interfaces between a pair of upward-pointing floor lanterns 112L for Floor 0 which are associated with an UP pushbutton 116L located therebetween at the same floor location. The hall fixture circuit board 108a/b is further connected to communicate with a pair of upward- and downward-pointing floor lanterns 114L for the 1ST floor and also the UP and DOWN pushbutton set 118L positioned therebetween. The corridor location of the leftmost floor lanterns 112L and 114L may be associated with the hoistway location served by car "A", and the floor lanterns to the immediate right side of pushbuttons 116L and 118L are then associated with the corridor location proximate to the hoistway 16b served by car "B". The pushbuttons 116L and 118L are displaced on a vertical center line from floor to floor which may be used to serve this two-car-pair of adjoining or spaced hoistways which are not so far physically removed from one another. It is intended that when the invention is used for a two-car-pair the hall fixture circuit board 108a/b bi-directionally communicates with all of the associated hallway fixtures in the two-car-pair. With the special arrangement of the present invention, there is a measure of redundancy in the fact that micro-computer 80a can provide the complete control over the HOISTWAY DATALINK 82a as can microcomputer 80b on the hoistway riser 82L.

Another hall fixture circuit board 110a/b is also located between the same pair of floors as hall fixture circuit board 108a/b, but it is intended for the purpose of serving one or both of these floors, 0 and 1ST, at a rear entrance door or doors of elevator cars 12a and 12b. Elevator systems with this arrangement are in frequent demand for passenger and rear door freight movement between the floors of many building structures. The rear hall fixture circuit 110a/b provides for the same complement of hall fixture signalling and lighted directional indications of pushbuttons and of upward and downward directional arrows as does the hall fixture circuit board 108a/b.

Near the top of the hoistway 16b is another identical hall fixture circuit board 120a/b located at an appropriate position to serve the 6TH and 7TH floors by interfacing the shielded pair conductors 106a/b of the hoistway riser 82L, with an upward- and downward-pointing directional pair of floor lanterns 130L and UP and DOWN pushbuttons 132L for the 6TH floor in communication with the hall fixture circuit board 120a/b. This is on the same communication circuit as the downward-pointing pair of hall lanterns 126L associated with the DOWN pushbutton 128L of the 7TH floor. The manner of serving the hoistway location of car "A" is with the leftmost directional pair of floor lanterns 130L and 126L and likewise the floor lanterns to the immediate right of pushbuttons 132L and 128L is for car "B" similar to that as for the lower floors previously described. And the same is true for the horizontal position indicator 122L for car "A" on the left and horizontal position indicator 124L on the right for car "B" in order to provide a reading of the location of the respective elevator cars 12a and 12b during the movement of same so that potential passengers who are waiting at the terminal landings of the building structure are given a fair amount of notice of when to prepare to enter the car when it reaches their respective floor.

Another information display part of the elevator system 10 which is present in a two-car-pair resides in the status panel 134 which is typically provided in a central location of the building structure which may be in the building manager's office or at the concierge's desk in the lobby of the building. The status panel 134 communicates with the micro-computer 80*a* or 80*b* via the conductors 106*a/b* assembled in the hoistway riser DATALINK 82L. This provides a display of position indicators such as LEDs for each elevator car in the two-car-pair 12*a* and 12*b*, along with some status indicators for indicating car position on the floor being served by each elevator car and the direction in which it is proceeding.

The status panel 134 is shown at floor 0, and it is also central to its position for a bank of elevator cars which are formed by a dual two-car-pair with cars "C" and "D" constituting the second two-car-pair. With certain exceptions it should be noted that the two-car-pair to the right of center in FIG. 1 is essentially a mirror image of the various corridor fixtures such as floor lanterns 112R and UP pushbutton 116R (R designating right side) which are controlled by a hall fixture circuit board 108*c/d* which interfaces therebetween. This is at about the same vertical height in the building structure in hoistway 16*c* rather than hoistway 16*b* which provides the location for the hall fixture circuit board 108*a/b*. It is essential to the invention when used in a dual two-car-pair that a second HOISTWAY DATALINK 82*c* and 82*d*, consolidated into the hoistway riser 82R, be used to provide the bi-directional communication over a set of three conductor twisted shielded pair 106*c/d* for the second two-car-pair of cars "C" and "D". This serves the various hall fixtures in the mirror image portion and supplies the status panel 134 with information concerning this two-car-pair. An alternative would be to use a status panel of similar construction but separately located or used, despite the provision of related service with a four car bank of cars being involved.

The present invention described thus far with respect to the showing in FIG. 1 has not made specific reference to the alternative showing of a hydraulic elevator system 10 with the #0 micro-computer 80*a* teamed with a #0 pump unit of a hydraulic power supply 32*a*. The communications described is portable to this type of system with minor changes accordingly. With the hydraulic elevator system 10, equipment in the penthouse 19 such as the drive machine 22*a* and car controller 24*a*, along with the wire ropes 18*a*, sheave 20*a* and CTWT, are likewise absent or removed. Likewise, the car communication link 28*a* between the micro-computer 80*a* and the car controller 24*a* is no longer necessary since the elevator car 12*a* is driven by the hydraulic system from the pump unit 32*a* through supply pipe sections 60*a* to drive a hydraulic jack 40*a* (shown in phantom since considered in the alternative). As shown in phantom for the car "A" the hydraulic system can use multistages 42*a* with 43*a* being the intermediate section thereof. A single acting piston or plunger 42*a* fixed to the underside of the car 12*a* is also sufficient in order to move the car according to the movement of the plunger 42*a*. The base of the jack 40*a* is to be firmly anchored to the base of the building structure or ground. Similarly, hydraulic power supplies 32*c* and 32*d* are respectively designated #2 and #3 pump units all located in the machine room 26 and each is controlled by correspondingly designated micro-computers 80*c* and 80*d*. The hydraulic jacks 40*c* and 40*d* complete the hydraulic drive systems through the supply pipe sections which are appropriately routed and designated 60*c* and 60*d*, respectively.

Although the description does not show that the #1 micro-computer 80*b* in any but a traction elevator configuration, it is not to be regarded as unassailable for the mode of movement by hydraulic means in order to provide a uniform bank of hydraulically driven elevator cars consisting of a dual two-car-pair bank in the preferred embodiment. The versatility of the present invention, however, makes it readily applicable to any two-car or plural two-car-pair which may include matched or unmatched car pairs be they traction elevator or hydraulic elevator car-pairs or otherwise. It is fundamental to the invention, however, that the two-car-pair of cars "A" and "B" are provided with a third bi-directional communication link 133*a/b* connected between their respective micro-computers 80*a* and 80*b* so that they may communicate with each other. One of these two micro-computers can then tell the other that it is the floor control (FC) master of the hallway serial link, meaning bi-directional communication via the hoistway riser 82L, and that the other micro-computer such as 80*b* should remain on standby for the job of FC master of the hallway serial link in case there should be a failure of communication of the micro-computer 80*a*. This is done in order to implement the floor control master strategy for answering hall calls should 80*a* fail or if there is a communication failure such that micro-computer 80*a* cannot communicate with micro-computer 80*b* over the third communication link 33*a/b*.

The invention also provides that if there are two FC masters currently operating redundantly, as micro-computer 80*a* and 80*b*, then the micro-computer having the lower car station address (#0 smaller than #1) micro-computer 80*a* will continue to be the FC master with the micro-computer 80*b* being cleared of this responsibility. A similar third bi-directional communication link is present between the #2 and #3 micro-computers 80*c* and 80*d* with a similar purpose for the operation of the two-car-pair including cars "C" and "D". Still another third bi-directional communication link 33*b/c* connects the #1 and #2 micro-computers 80*b* and 80*c* in order to provide that each of the micro-computers can talk over this third bi-directional communication link, especially those that are the floor control masters for the respective hallway serial links 82L and 82R in a dual two-car-pair elevator bank. One of the FC master controllers or micro-computers 80*a* and 80*b* will further assume the additional role as dispatcher or bank control (BC) master which serves as a dispatcher for all of the car associated micro-computer controllers in the elevator bank. This BC master functions to supervise all of the cars and process all of the hall calls in order to select for each hall call the best car to assign to it based on the relative car travel position and in order to minimize waiting times for service and provide passenger convenience tht is enhanced.

Figure 2:
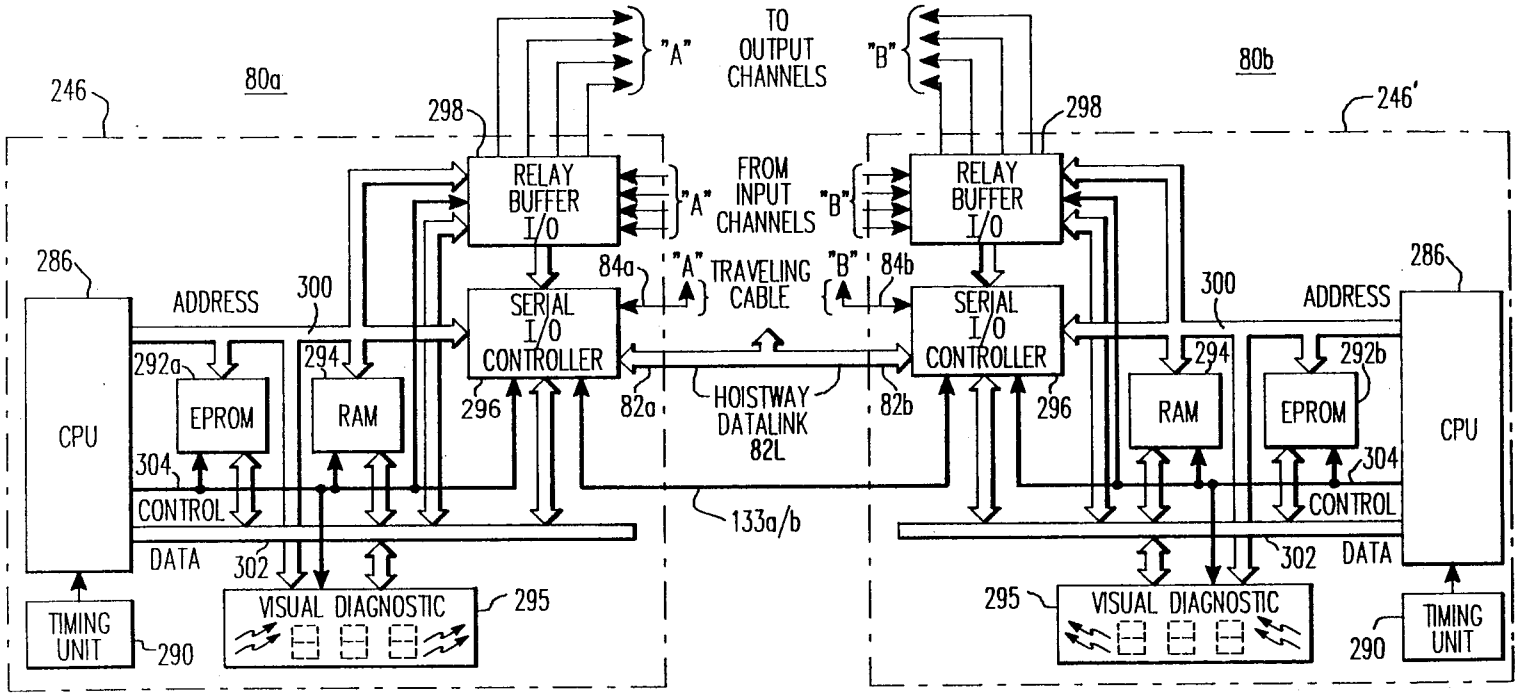
FIG. 2 is a block diagram of a pair of microcomputer circuits each of which are associated with a car in the elevator system of FIG. 1.

FIG. 2 shows the micro-computer circuit 80*a* located within block 246 on the left side of the page and micro-computer 80*b* within block 246' which is substantially the mirror image of block 246 in order to represent that there is a substantially identical special purpose microprocessor based controller designed to control the overall operation of each car "A" and "B". A substantially similar showing of the micro-computer 80*a* within block 246 has been shown in FIG. 7 of the related U.S. patent application Ser. No. 064,913 filed June 19, 1987 and entitled "Elevator System Leveling Safeguard Control And Method" which has been incorporated by reference into the present application. The last mentioned U.S. patent application describes a car controller which implements program control functions which incorporate elevator safety codes to insure safe operations.

Figure 3:
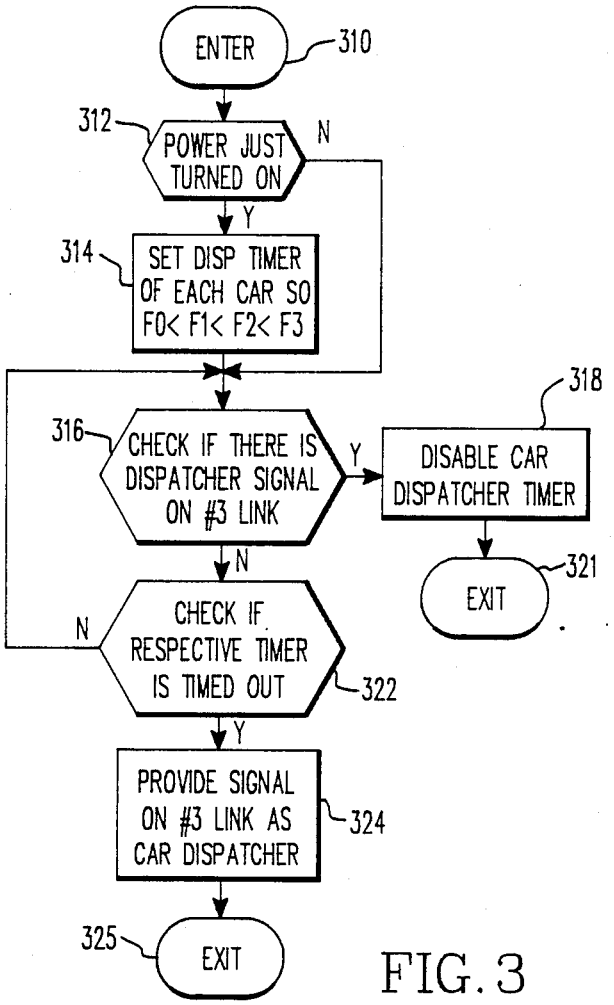
FIG. 3 is a flow chart of an abbreviated program module of the type which may be programmed into the EPROM within each microcomputer circuit of FIG. 2 and run in a repeating sequence in order to switch a dispatcher or bank controller (BC) master strategy for plural two-car-pair sets.

Another slightly modified showing of the micro-computer circuit 80*a* within block 246 was presented in a hydraulic elevator system incorporated by reference into the present application by the showing of FIG. 3 in U.S. patent application Ser. No. 064,915 also filed on June 19, 1987 and entitled "Elevator System Monitoring Cold Oil". Both of these applications are assigned to the same assignee as the present application. This latter referenced U.S. application utilizes the microprocessor within block 246 to implement a program to inactivate an in-service elevator car during which time a hydraulic drive pump is activated to pass oil through a route which bypasses the hydraulic jack in order to bring the hydraulic oil up to an operating temperature to provide smooth starts and prevent damage to the motor and associated equipment.

The present FIG. 2 is substantially similar to the figures mentioned for the incorporated U.S. applications, and the reference to features and the numerals used within blocks 246 and 246' are identical for the most part, with the exception of modified portions which concern the present invention, as will become apparent from the following description. The micro-computer 80*a* controls the overall operation of a car 12*a* such as in the alternative hydraulic elevator system 10 shown in FIG. 1 via the bi-directional communication path in the traveling cable 84*a* and similarly for traveling cable 84*b* and the microcomputer 80*b*. A similar bi-directional communication path for the corridor fixture signalling functions is seen for the HOISTWAY DATALINK 82*a* joined in common with 82*b* which may communicate with either of the identically numbered CPUs 286. These are the respective central processing units either or both of which can receive information through a respectively numbered serial input-/output controller 296 through an ADDRESS bus 300, DATA bus 302, and CONTROL 304.

The CPUs 286 are both highly-integrated 8-bit units that are designed to operate at 6-MHz operating speed and are of the type available from INTEL with a Model No. 80188. Also in the circuit 246 is the random access memory RAM 294 which can provide 8K bytes of data storage, a portion of which can retain approximately 2K bytes of data in extended long-term storage in the absence of any operating supply voltage except for a long-term shelf life storage battery. An EPROM memory 292*a* is present in circuit block 246 and a similar EPROM 292*b* is present in circuit block 246' with each of these memory devices being split into two sections which can both either be 32K or 16K bytes of the same type of programmable "read only" memory which is available for storage of the main processing functions. The EPROM programs are sequentially stepped through by the respective CPUs 286 as a chain of continuous subroutines for operating the hydraulic elevator system under consideration and its various car signalling, control, and strategy functions as well as for corridor signalling processing functions.

A visual diagnostic module 295 is provided to indicate the status of the micro-computer circuit 246, and along with the respective EPROMs 292*a* and 292*b* and RAM 294, communicate with the respective CPUs 286 over the buses 300 and 302 with control from 304 which is likewise used for an input and output of information to devices which communicate with the external portions of the system. Communications networking and higher voltage interfacing is available on relay buffer I/O 298 for the respective input and output channels of cars "A" and "B". A more detailed explanation for these channels is presented in the incorporated U.S. application Ser. No. 064,913, filed on June 19, 1987, as previously referenced above.

Figure 4:
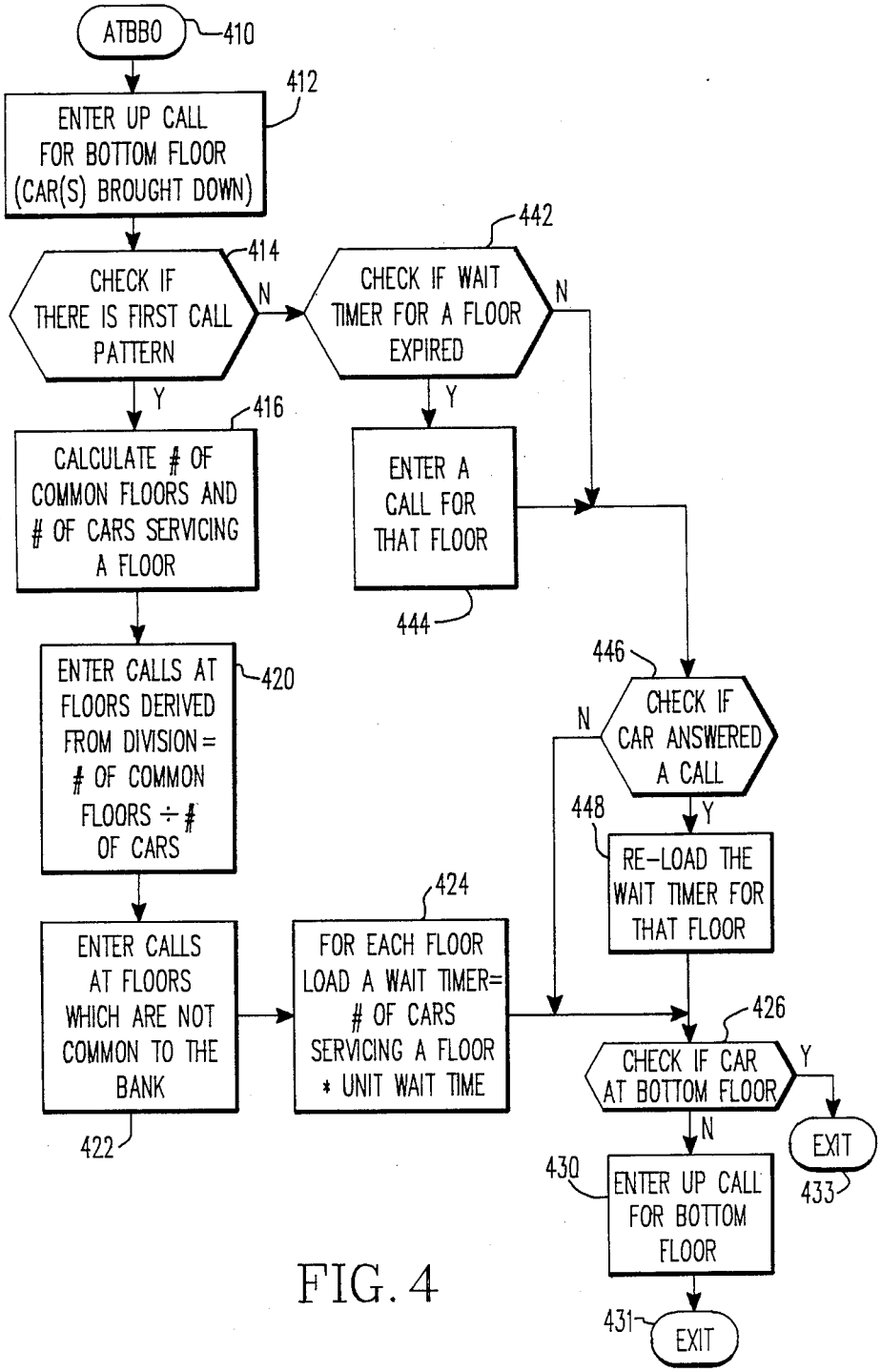
FIG. 4 is a flow chart of a program module ATBBO with its associated sequencing routine which is programmed into the respective EPROMs of the microcomputer circuits of FIG. 2 and run in a repeating sequence in order to implement the adaptive block operation strategy for servicing hall calls.

A serial input/output I/O communication controller 296 in each micro-computer circuit block 246 also communicates on the address bus 300, data bus 302 and control line 304 with its serial interfacing functions being present on the outputs for the respective CAR DATALINKS 86*a* and 86*b* being present in the respective travelling cables 84*a* and 84*b*. Two interdependent floor controller links utilize the respective serial controllers 296 for the HOISTWAY DATALINK with the merger of 82*a* and 82*b* for the HOISTWAY riser 82L. This serves the bidirectional communication path with the appropriately selected floor control (FC) master of the hallway serial link which provides all of the corridor fixture signalling functions such as pushbutton hall calls, visual lanterns, and audible car position signalling. The selection process for the FC master controller will be seen more clearly with respect to the description of the program module FCMHSL with its associated sequencing routine, as shown in FIG. 4 of incorporated U.S. Ser. No. 109,638, which is programmed into the respective EPROMs 292*a* and 292*b*. This is shown herein for a two-car-pair elevator system, whether it be driven by a traction drive or implemented with hydraulic power drives. A further description of this pairing of elevator controllers of the same micro-computer construction is not further shown for the car "C" and "D" since it would merely be redundant, with the understanding that the same program modules including FCMHSL are to be resident in the respective EPROMs therein. These programs depend for effectiveness on their taking communication control for the purpose of FC master switching or dominance by one of the micro-computer circuits of each two-car-pair. This is based on the FC master controller with the lower car station address taking priority, unless there is some communication failure on the corridor serial link in which event the associated car may put on block operation as will be further seen with respect to FIG. 4.

The communication between micro-computers 80*a* and 80*b* also includes a third bi-directional communication link 133*a* which connects between a remaining capacity for handling multiple communication links by the respective serial I/O controllers 296. Each microprocessor circuit 246 is able to handle multiple communication links of, for example, up to five (5), with certain links being capable of enabling and disabling the drivers so that loading of a single line is avoided. As described with respect to FIG. 1, a similar bi-directional communication link 133*c/d* was said to exist in the manner of communicating between the micro-computers 80*c* and 80*d*. This was also described for the communication linkage 133*b/c* which exists in the dual two-car-pair so that communication between selected remote FC master controllers, such as the 0 and 2 micro-computers 80*a* and 80*c*, can take place during conditions of the normal selection process with unimpaired communications. These are the remote controllers with the respective lower car station addresses relative to the other car station addresses of the two-car-pair sets of remote controllers as previously defined. The provision of the third bi-directional communication links 133*a/b*, 133*b/c*, and 133*c/d* also provides the proper communication serial path so that the FC master controller can transmit information to its associated remote controller as well as to the FC master of any other two-car-pair of remote controllers, such as over the third bi-directional communication link 133*b/c*.

This communications link also make possible the sharing of one of the selected remote controllers to act as a dispatcher or bank control (BC) master for the switching strategy. This provides that all of the remote controllers can token pass so that each remote controller is given an opportunity to transmit while all the other controllers receive, in a sequential or orderly manner, until the token is given to the next remote controller. This is done in order to communicate such information as the car travel position, the direction of travel up and down, when the car is stopped, and whether the doors of the car are open or in the closed position. This is an RS-485 type of communication protocol which allows the remote controllers to communicate with the corridor fixtures through the respective clocking of serial input data ±SID in order to provide the serial output data ±SOD so that the remote controllers can recognize that there is a hall call entered at any of the pushbutton locations such as 118R at FLOOR 1. This will be entered into a Table of Calls, and this information will be communicated to the FC master or #2 micro-computer 80*c* which will communicate this information on the third bi-directional communication links 133*b/c* and 133*a/b*.

The other normally chosen FC master #0 micro-computer 80*a* will also recognize that there is a hall call, and car "A" or "B" controllers will then output a serial message on the HOISTWAY DATALINK 82L so that there will be synchronization between the corridor fixtures 118L and 118R such as lighting and extinguishing the pushbuttons. The same is true with respect to the floor lanterns 114L and 114R during the servicing of the floor 1 since all calls signalled by the dispatcher or BC master direction is a function inherently directable to any one of the micro-computer remote floor controllers. Since each of these remote controllers operate under the same program control, with the exception of priority. The assumption in the floor control strategy is based on the setting of timers for each remote controller in proportion to the car station address so that priority proceeds from the lowest car number to the highest if there is failure in elevator service.

Referring now to the flow chart of FIG. 3 which is an abbreviated program module of the type which may be programmed into the EPROM within each micro-computer circuit of FIG. 2, the CPU 286 begins the serial sequencing at the label 310 and proceeds to make a pass through various decision steps which are contained within a hexagon-like containers such as at 312 and 316 and rectangular-type containers for the action blocks such as 314 and 318 in a traverse of the flow diagram in order to reach a label 321 designated as EXIT. The CPU 286 will proceed to serially step through any relevant program routines which are designated to be sequenced during the time that this module is being run, and the discussion of other modules of this type would present a chain of continuous subroutines for operating the elevator system and its various car signalling, control, and corridor signal processing functions. This extension would unreasonably inflate the description of the present invention beyond the necessity to do so.

The first decision step 312 shown in FIG. 3 checks to see if the power to the elevator system has just been turned on, and since the power has just been turned on at 310, the answer is yes "Y" so the action block 314 sets the DISP timer in RAM 294. This is done in order to provide a program type counter or software counter which may be set at a different value for each remote controller corresponding to the length of time that the timer is to be active before timing out. For example, the minimum timer F0 may be set to 00000111 binary which corresponds to 7 hexadecimal (HEX), also corresponding to DECIMAL 7. A counter may be set to count at 0.5 second intervals, so for counting down from 7, the time it would take would be 3.5 seconds. The #1 remote controller timer F1 may be set for 00001001 binary, corresponding to 9 hexadecimal, also corresponding to DECIMAL 9 and therefore 4.5 seconds for counting down from 9. Likewise in order of increasing magnitude timer F2 represents a count of 5.5 seconds and timer F3 may be set for 6.5 seconds in order to provide a staggered relationship of the type described or otherwise. The DISP timer will each count down from a different value in order to allow the time out of counting from the lowest numbered car to the highest unless there is the disablement of timers which should occur immediately after a dispatchers signal is detected on the #3 link. This corresponds to the multi-car communication link which corresponds to the third bi-directional communication link 133*a/b* in FIG. 2.

After the respective timers have been set, the next decision step 316 checks to see if there is a dispatcher signal on the #3 link. If the answer is affirmative the action block 318 disables the dispatcher timer of this car which has been presumed to be enabled and in the process of counting out since the power was just turned on. This will indicate that a DISP timer which has become disabled is not the minimum timer F0 which would have counted out after 3.5 seconds according to the example. It would be still counting after 3.5 seconds corresponding to the DISP timer's F1, F2, or F3 which correspond to 4.5, 5.5 and 6.5 seconds respectively. Considering that the minimum timer F0 would not be disabled, because of the decision step 316 finding that a negative would be the answer to checking if there is a dispatcher signal on #3 link, the DISP timer for the #0 micro-computer 80*a* would proceed to count out through the decision step 322 checking if the respective timer is timed out. The answer is no "N" so proceed to loop back through decision step 316 until the timer F0 is actually found to be timed out by decision step 322 after 3.5 seconds.

The affirmative answer to decision step 322 then proceeds through action block 324 to provide a signal on the #3 link as car dispatcher, and the exit from block 324 is through label 325. This would provide a signal to all of the remote controllers to stop counting out the respective DISP timers at decision step 316 which is being sequenced by each of the remaining micro-computers 80*b*, 80*c* and 80*d* which receive the signal on the multi-car communication #3 link and thus proceed with a yes "Y" to the right action block 318 to disable the respective car dispatcher timer before the exit at label 321.

In this manner the remote controller with the #0 micro-computer 80*a* has priority to become the dispatcher or bank control (BC) master of the bank of cars and assigns the car to answer the corridor calls after it calculates which of the cars can get there in the most expedient manner. The dispatcher knows where every one of the elevator cars is located because it communicates with every other microprocessor for the bank of cars in the system, and the invention proceeds in a manner to automatically transfer dispatcher control in a plural two-car-pair elevator system. This occurs upon a continuous communications failure between the remote controller selected to be the dispatcher, originally, and the other cars in the bank. Likewise there is a switching of the dispatcher function upon shutdown of the remote controller that was selected to be the dispatcher. This occurs in an orderly sequence which will be described further.

The description for implementing the floor control (FC) master strategy for servicing hall calls proceeds, according to a similar priority. This priority is based on similar but separate timers utilizing RAM 294 in order to provide a second set of program type counters or software counters which may be set at different values or four different time intervals FC0, FC1, FC2, and FC3, simply by the program insertion of a number of counts corresponding to the length of time that the timer is to be active. The same relative magnitude for the minimum timer FC0 of 3 seconds is chosen as it may be represented in various numbering systems with the counter rate at 0.5 second intervals thereby counting down from DECIMAL 6. The proportional scale in seconds for FC1, FC2, FC3 is likewise chosen to differ from each other by one second respectively and from timers used for the DISP timers thereby 4, 5 and 6 seconds, respectively.

The flow chart for FIG. 4 is for a program module ATBBO with its associated sequencing routine which is programmed into the respective EPROMs 292*a* and 292*b* of the micro-computer circuits of FIG. 2. It is run in a repeating sequence in order to implement the adaptive block operation mode which is triggered on a per car activation by its associated controller micro-computer circuit 80*a*, 80*b*, in either two-car-pair shown in FIG. 1. It is possible for any car and its associated remote controller, such as car "A" and 80*a*, to activate the program ATBBO, 410 which is an acronym designation for "Adaptive Time Based Block Operation". If in a two-car-pair, as with car "B" and micro-computer 80*b*, it may likewise activate the ATBBO program module which is respectively run by a CPU 286 with the associated RAM 294 of FIG. 2.

When each of these controllers is unable to communicate on the serial hoistway riser 82L or if each has failed to gain control of this interface with the distributed corridor fixtures such as through hall fixture circuit board 108*a/b* then each is unable to communicate therewith. In the event that micro-computer 80*a* could continue to communicate on the hoistway riser 82L in order to respond to hall calls for service from passengers on the multiple floors thereof, car "A" should continue as or resume operation as a single car system in order to respond to these hall calls in a manner which would not affect the adaptive block operation for car "B". Likewise, if the communication with the hoistway riser 82L was not possible for "car A", its controller could thereupon activate the program for adaptive block operation while the micro-computer 80*b* would gain control of the hallway serial link and become active as a single car system to respond to the hall calls for service thereon. This operational mode of service for either car to be operated as a single car system with the other car put on block operation corresponds to MODE 2 and is given a further discussion with respect to FIG. 4 of same in the incorporated U.S. application Ser. No. 109,639 entitled "Elevator System Graceful Degradation of Bank Service".

Another communication contingency which is described more fully in the last mentioned incorporated reference is the situation where a plural two-car-pair of controllers is operating, for example, on respective hoistway riser 82L for cars "A" and "B" and hoistway riser 82R for cars "C" and "D" and each of the controllers associated with the respective cars will initiate block operation in MODE 3 if there is a lack of communication with at least one corridor riser. The same holds true if there is a lack of communication between respective two-car-pair controllers and there is no interface for communication signals with any of the corridor fixtures by any selected car which also initiates block operation for all of the cars as in MODE 3 of this reference.

The present description for the operational sequencing of the ATBBO program module of the present description is especially suited to operate in conjunction with the elevator system disclosed in the last-mentioned U.S. application Ser. No. 109,639 since it further enhances the minimal restrictions imposed on individual controller operational strategies, as well as for those in a plural bank operation of cars. Even the situation where all of the cars go on adaptive time-base block operation provides total service to the building with the least amount of restriction in order to take full advantage of the distributed control system implemented with micro-computer circuits. The one restriction for adaptive block operation according to the present invention is that necessitated by the lack of hall calls for service because of the serial link communication failure. This limitation is overcome at the outset by the creation of call patterns so that the car continues to service the building efficiently and not exhaust the system in doing so when it goes on adaptive block operation.

After entering the program module ATBBO at label 410 in FIG. 4, the first step at action block 412 enters an up-call for the bottom floor of the building for the respective car "C" or "D". Either car or both cars may be used for purposes of this example, assuming that both of these cars are designated for block operation by their associated controller repeatedly checking to find a lack of communication signal control on the serial riser 82R. The entering of an up call for the bottom floor constitutes a "dummy call" for the car or cars that are beginning to go on the adaptive block operation. The CPU 286 responds to the dummy call entry at block 412 through the sequential operation of a call routine and running routine modules in order to send the elevator car "C" to the bottom floor or landing 15*c*.

The door opening routine is set so that with the entry of a dummy call for the bottom floor, the front car doors 13*c* and 13*b*, as well as the rear car doors (not shown) are signaled to be opened when the cars reach the bottom floor so that any passengers therein may exit from the car.

It may be assumed that communication previous to the failure of the serial hoistway riser 82R provided information to all of the controllers of the bank, branching over the multi-car communication links 133*c/d*, 133*b/c* and 133*a/b* so that information about each car is present in the bank of controllers. This provides an indication of which floors each of the other controllers can service and how many of the cars in the bank are operating in the adaptive block operation mode. Whenever two cars such as "C" and "D" are both on adaptive block operation, one car cannot go above a certain floor such as FLOOR 3 and the other car on block operation cannot go below FLOOR 4. This assumes for the purpose of this example that the building has FLOORS 0 to 7 which are equally divided between these two cars when run on adaptive block operation.

The first decision step 414 checks to see if there is a first call pattern which may be stored in a scratch pad memory in RAM 294 providing a status report for car "C" at the time just prior to the car reaching the landing or bottom floor 15*c*. If there is a first call pattern in the status report, it contains the quantitative information of how many cars are in the bank, how many floors they can serve, and which car numbers as involved, i.e. #2 for car "C" and #3 for car "D". After car "C" comes down to the bottom floor, the first call pattern is then set or decided based on the remaining floors which are not common to the bank. So if there is a first call pattern at decision step 414 in the affirmative "Y", an action block 416 calculates the # of common floors, which means the floors which more than one car can serve, and it also calculates # of cars in the bank servicing a floor within the building set of FLOORs 0 to 7.

Let us consider, for example, there are six (6) common floors that more than one car can serve and that there are three (3) cars in a bank that may service these common floors. This calculation precedes as information for the next action block 420 which enters the calls at floors derived from a division equal to the # of common floors divided by the # of cars that can serve these common floors, or in the above example equals two (2) with the calls being entered therefore or given out accordingly. This is an equal division among all of the cars that can serve the common floors, so that there is no overlapping on the servicing of the floors through repeated sequencing. There is no reduction in the efficiency such as there would be if service were overlapping.

The next action block 422 enters the calls at the remaining floors of the building which are not common to the bank of cars servicing the common floors. This is done in order to put in of calls for a car that can only serve one floor which, for example, we designate car "A" to be used exclusively for moving passengers between floors 0 and 7 which is the top floor the building in FIG. 1. Car "A" will then get the call to serve passengers on FLOOR 7 automatically, since this floor is not common to the bank and since cars "B", "C", and "D" are cars serving the six common floors which may be for this example FLOORS 0 to 5.

The next action block 424 provides for the loading of software timers designated by the terminology "wait timer" which provides a countdown in time for each of the cars which has a wait timer for all of the floors. The action block 424 thus for each car loads a timer equal to the # of cars serving a common floor multiplied by a value of unit wait time which corresponds to two (2) minutes if only one car could service a particular floor. If two cars could serve a common floor, the wait timer setting for this floor in each of the respective car controllers would be four minutes. The counter may be set to count at 0.5 second intervals, so for counting down from 240, the time it would take would be 120 seconds or 2 minutes which is the case for a unit wait time. This also corresponds to F0 hexidecimal (HEX) and 11110000 binary in order to count down from DECIMAL 240 in the required unit wait time.

Each car brought down to the bottom floor has its respective controller micro-computer 80*b*, 80*c*, and 80*d* loaded with a separate timer for each floor that the respective car can service at the start of a run from the bottom floor. Then the initial set of hall calls in the initial pattern is entered so that the respective cars may answer these hall calls in the first pattern with the individual wait timer for each floor having been set in each car associated micro-computer. Therefore each car will have a different time in its timer for each floor because each car serves the respective floor at different times. This changes the timer since a particular car cannot go and serve all of the floors at the same time. This fulfills the requirement that there be some gap in the time that would skew the time by an amount that it takes to run to a particular floor.

The next decision step 426 checks to see if the car is at the bottom floor, which if answered in the affirmative the exit is to the right at label 433. If the answer is negative, the action block 430 enters an up-call for the bottom floor which is similar to the action block 412 at the start of the ATBBO program module which has been previously described as entering a dummy call. If the decision step 414 checks if there is a first call pattern and the response is negative, the next decision step 442 checks if a wait timer for a floor has expired on any of the floors which are not common to the bank but can be serviced by car "C". If the answer is yes "Y", action block 444 enters a call for that floor which is a floor that only one car can service. If, however, the checking step 442 discovers that the wait timer for a particular floor has not expired, the next decision step 446 checks if the car answered a call. When a car answers a hall call its timer is loaded again to the wait time multiple of two minutes which will be four minutes in the example where it is one of two common cars that can service that particular floor.

Each time a floor is serviced action block 448 re-loads the timer for that particular car set for that particular floor, so as to ensure that you do not wait too long a period of time for service again to that floor. The time you can set the respective timer for that floor is when car "C" has answered a call at that floor. Another time when the timer for a particular floor served by car "C" is loaded is when a car call is answered for the designated floor, as registered by passengers in the car who have decided to go to that floor. The resetting of the timer when the car is at that floor eliminates the possibility of having to go back to that particular floor again with car "C" until the timer times out for that floor in which event a call is put in for that floor in order to generate the pattern.

With the wait time for a particular floor and common car being associated directly proportional to the number of cars it is serviced by, service to the particular floor is shared by all of the cars on block operation. Wait times are proportional to the number of common cars servicing a particular floor and the timing is enhanced for this adaptive time based block operation to thereby service the building more efficiently. The adaptive block operation program module ATBBO is especially suited to the task of operation with two-car-pair elevator systems which may be extended to a plurality of two-car-pair elevator systems, although it has been described with respect to one or more controllers in a distributed processing network. No special software is required for different or extended building configurations which is to be regarded as an extension of this concept.

We claim as our invention:

1. A method of controlling a plurality of elevator cars for protecting against an excessively restricted block operational mode of elevator service from each floor of a building, with each car communicating on a local area network from an electronic circuit located thereat and through a separate traveling cable to a remote controller, each remote controller including a microprocessor based computer circuit individual to each car and with each remote controller normally capable of communicating corridor signal information on a local area network through a riser cable terminating in a set of floor control circuits distributed proximate to each floor, each said microprocessor based computer circuit adaptively implementing successive failure control modes for a floor control strategy to assign the better car or cars into operation, based on communication network integrity, relative car travel positions and timing, to respond to the hall calls registered at the floors along said cable riser, and each said remote controller repeatedly checking its operational capability and communication signal integrity for the corridor cable riser so as to respectively being implementing an adaptive block operation mode, with the least restrictive affect in the floor control strategy, should there be a communication failure affecting the respective remote controller from communicating on the cable riser, with the capacity for totally servicing the building in moving passengers to the bottom floor.

2. The method of claim 1 wherein the implementing step for the adaptive block operation provides that each remote controller initializes loading a timer for each floor when the associated car is brought down to the bottom floor and begins counting down a wait-timer, starting from when the car begins to move up from the bottom floor, so that a hall call is answered at a particular floor, thereafter reloading the wait timer at the particular floor with a wait-time identical to that which initialized the timer loading, which is directly proportional to the number of cars that the floor is being serviced by, and sharing the service to the floor by all the controllers associated with cars that are activated on block operation.

3. The method of claim 1, wherein the step of each remote controller microprocessor based computer circuit for communicating corridor signal information over a local area network is implemented by bi-directionally communicating in serial signal transmission format through the riser cable or hallway serial link for so long as it is a viable network, as determined by the checking step for implementing the adaptive block operation for each controller not able to communicate signals on the riser cable in response to registered hall calls.

4. The method of claim 1, wherein said plurality of elevator cars is in a two-car-pair operating system and the remaining controller, associated with the remote controller which begins implementing the adaptive block operation, are each adapted to operate their respective microprocessor based computer circuit for fully implementing a single car system with a floor control strategy as the hall call response for said two-car-pair, after being selected by said repeated checking step, the selected controller implementing the floor control strategy by itself responding to the hall calls registered at the floors, for so long as a communication path is viable, while concurrently controlling the car response individual to its registered car calls local to the car.

5. The method of claim 1, wherein said plurality of elevator cars is in an operating system which includes a plurality of two-car-pair sets of cars and the remaining controller, associated with the remote controller which begins implementing adaptive block operation within each set, each includes a microprocessor based computer circuit fully implementing a single car system floor control strategy as the hall call response, respectively, for each side pair of said plural two-car-pair, and being selected for operation by said repeated checking step, each of the respective selected controllers being capable of implementing the floor control strategy by itself by responding to the hall calls registered at the floors for so long as a communication path is viable, while concurrently controlling the car response individual to its registered car calls from the respective car.

6. A control system for controlling a plurality of elevator cars protected against an excessively restricted block operational mode of elevator service from each floor of a building, comprising:

a first local area network for each car having its car call signals communicating thereon and including an electronic circuit located with each car connected to a remote controller on a traveling cable, each remote controller including a microprocessor based computer circuit individual to each car, a second local area network for each remote controller to normally communicate corridor signal information through a riser cable terminating in a set of floor control circuits distributed proximate to each floor, each said microprocessor based computer circuit being adapted to implement successive failure control modes for a floor control strategy to assign the better car or cars into operation, based on communication network signal integrity, relative car travel positions and timing, to respond to the hall calls registered at the floors along said cable riser, and each said remote controller computer circuit including means for repeatedly checking its operational capability and the communication signal integrity for the corridor cable riser within the control system, so as to respectively begin implementing an adaptive block operation mode, with the least restricted affect in the floor control strategy, should there be a communication failure affecting the respective remote controller from communicating on the cable riser, with the capacity for totally servicing the building in moving passengers to the bottom floor.

7. The control system of claim 6, wherein an adaptive block operation program module in the respective controller microcomputers includes a time counter function providing a wait timer for each floor for time counting which begins counting out initially when the associated car begins to mvoe up from the bottom floor when a hall call is to be answered at a particular floor, a wait-time for each floor is loaded, initially at the bottom floor, which is directly proportional to the number of cars that the floor is being serviced by, and is reloaded after a call for the particular floor is answered, and sharing the service to the floor by all the controllers associated with cars that are activated on block operation.

8. The control system of claim 6, wherein said plurality of elevator cars is in an operating system which includes a plurality of two-car-pair sets of cars and the remaining controller, associated with the remote controller which begins implementing adaptive block operation within each set includes a microprocessor based computer circuit capable of fully implementing a single car system with a floor control strategy for the hall call response, respectively, for said plural two-car-pair, and being selected for operation by said means repeatedly checking its operational capability, each of the respectively selected controllers being capable of individually implementing the floor control strategy by itself responding to hall calls registered at the floors, for so long as a communication path is viable, while concurrently controlling the car response individual to its car calls from the respective car.

9. The control system of claim 6, wherein each remote controller microprocessor based computer circuit is adapted for serially communicating corridor signal information over the local area network which is implemented by bi-directionally communicating in serial signal transmission format through the riser cable or hallway serial link for so long as it is a viable network, as determined by the checking means for implementing the adaptive block operation for each controller which is not able to communicate a signals on the riser cable in response to registered hall calls.

10. The control system of claim 9, wherein said plurality of elevator cars is in a two-car-pair operating system and the remaining controller associated with the remote controller which begins implementing the adaptive block operation, are each adapted to operate their respective microprocessor based computer circuits to singularly implement a single car system with a floor control strategy for the hall call response for said two-car-pair, after being selected by said means repeatedly checking its operational capability, the selected controller implements the floor control strategy by itself to respond to hall calls registered at the floors for so long as a communication path is viable, while concurrently controlling the car response individual to its registered car calls local to the car.

* * * * *